US005820220A

United States Patent [19]

Wu

[11] Patent Number: 5,820,220

[45] Date of Patent: Oct. 13, 1998

[54] CHAIR WITH A FOLDING COLLAPSIBLE BACK

[76] Inventor: Tien Tzu Wu, No. 126-6, Shui Nan Road, Tai Chung City, Taiwan

[21] Appl. No.: 902,263

[22] Filed: Jul. 29, 1997

[51] Int. Cl.[6] ..... A47C 7/40

[52] U.S. Cl. ..... 297/378.1

[58] Field of Search ..... 297/53, 54, 378.1, 297/378.12

[56] References Cited

U.S. PATENT DOCUMENTS

| | | | |
|---|---|---|---|
| 2,280,231 | 4/1942 | Gulley | 297/378.18 |
| 3,807,792 | 4/1974 | Smith | 297/54 |
| 4,871,209 | 10/1989 | Handelman | 297/378.1 |
| 5,018,788 | 5/1991 | Cedergreen | 297/378.1 |
| 5,094,505 | 3/1992 | Nichols | 297/378.1 |
| 5,658,047 | 8/1997 | Ratza et al. | 297/378.1 X |

*Primary Examiner*—Peter R. Brown
*Attorney, Agent, or Firm*—Bacon & Thomas

[57] ABSTRACT

A chair including a seat having a transverse block upwardly raised along a rear side thereof and an upright stop plate with a front locating block vertically raised from the transverse block, and a back pivoted to the transverse block of the seat and turned within 90° angle between a first position perpendicular to the seat and a second position closely attached to the top side of the seat, the back having a transverse bottom chamber adapted to receive the transverse block of the seat, a transverse coupling trough adapted to receive the upright stop plate, and a locating block suspending in the transverse coupling trough which is forced into engagement with the locating block of the seat and stopped in front of the upright stop plate of the seat when the back is turned to the first position.

2 Claims, 6 Drawing Sheets

CHAIR WITH A FOLDING COLLAPSIBLE BACK

BACKGROUND OF THE INVENTION

The present invention relates to chairs, and more particularly to such a chair which comprises a seat supported on a chair stand, and a back pivoted to the seat and turned within 90° angle between a first position (namely, the operative position) perpendicular to the seat and a second position (namely, the collapsed position) closely attached to a top side of the seat.

Regular chairs are commonly comprised of a chair stand, a seat supported on the chair stand, and a back raised from the seat. FIG. 1 shows a regular chair A, in which the back A1 and the seat A2 are made in integrity. Because the back A1 and the seat A2 are made in integrity, the back A1 is not collapsible when the chair A is not in use. FIG. 2 shows another structure of chair B, in which the back B1 is connected to the seat B2 by two back supports B3;B3'. Because the back supports B3;B3' are fixedly connected between the seat B2 and the back B1, the back B1 is not collapsible. Because the aforesaid chairs are not collapsible, they need much storage space.

SUMMARY OF THE INVENTION

It is the main object of the present invention to provide a chair which has a folding collapsible back that can be turned between within 90° angle between the operative position perpendicular to the seat of the chair, and the non-operative position closely attached to a top side of the seat. According to the preferred embodiment of the present invention, the seat of the chair comprises a transverse block upwardly raised along its rear side, and an upright stop plate with a front locating block vertically raised from the transverse block; the back of the chair is pivoted to the transverse block of the seat and turned within 90° angle between the operative position and the non-operative position, having a transverse bottom chamber adapted to receive the transverse block of the seat, a transverse coupling trough adapted to receive the upright stop plate, and a locating block suspending in the transverse coupling trough which is forced into engagement with the locating block of the seat and stopped in front of the upright stop plate of the seat when the back is turned to the operative position.

DETAILED DESCRIPTION OF THE PREFERRED EMBODIMENT

Figure 6:
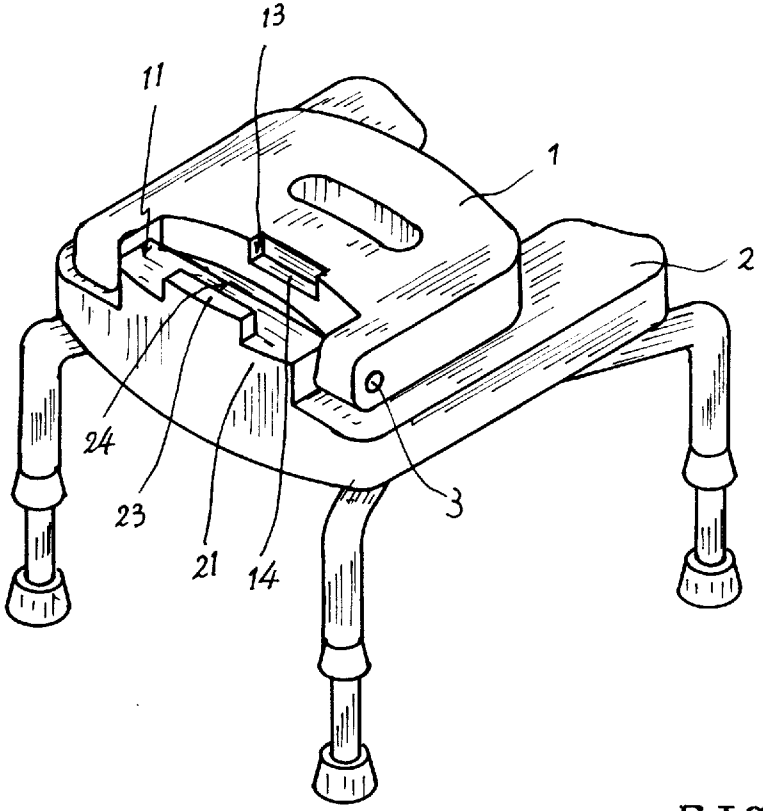
FIG. 6 shows the back collapsed and closely attached to the top side of the seat according to the present invention.

Referring to Figures from 3 to 5, a chair in accordance with the present invention comprises a seat 2 supported on a chair stand, and a back 1 pivoted to the seat 2 and turned between two positions within 90° angle, namely, the operative position perpendicular to the seat 2 (see FIG. 4), and the collapsed position closely attached to the top of the seat 2 (see FIG. 6).

Figure 1:
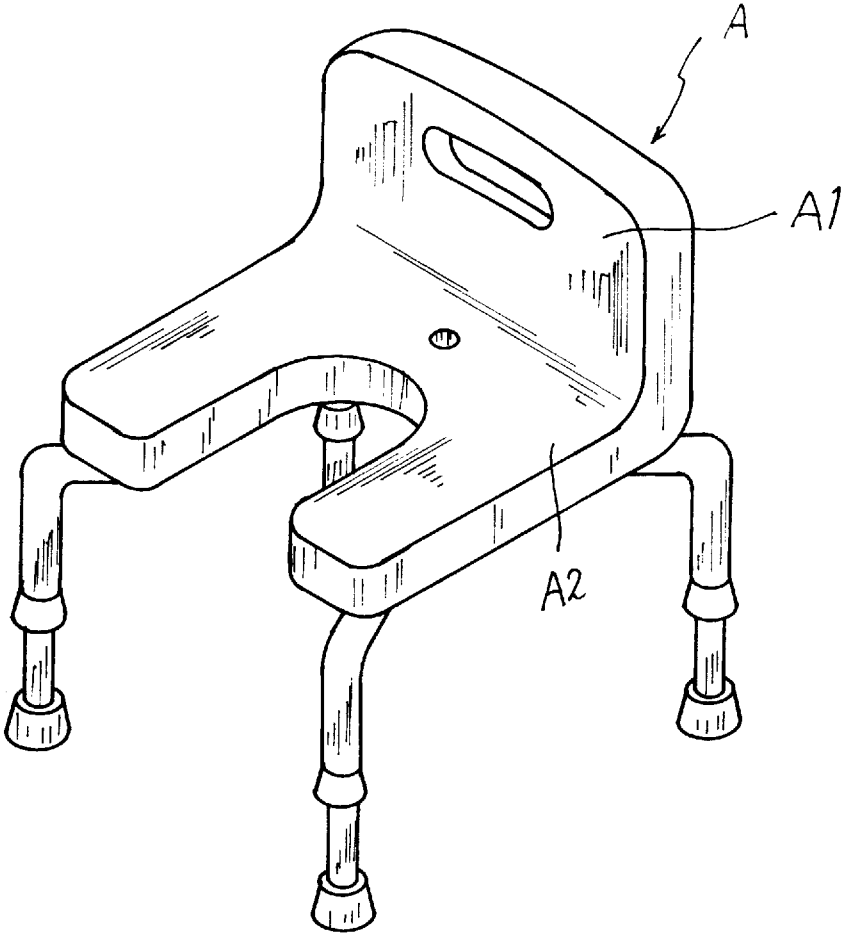
Fig. 1 is an elevational view of a chair according to the prior art.
Figure 2:
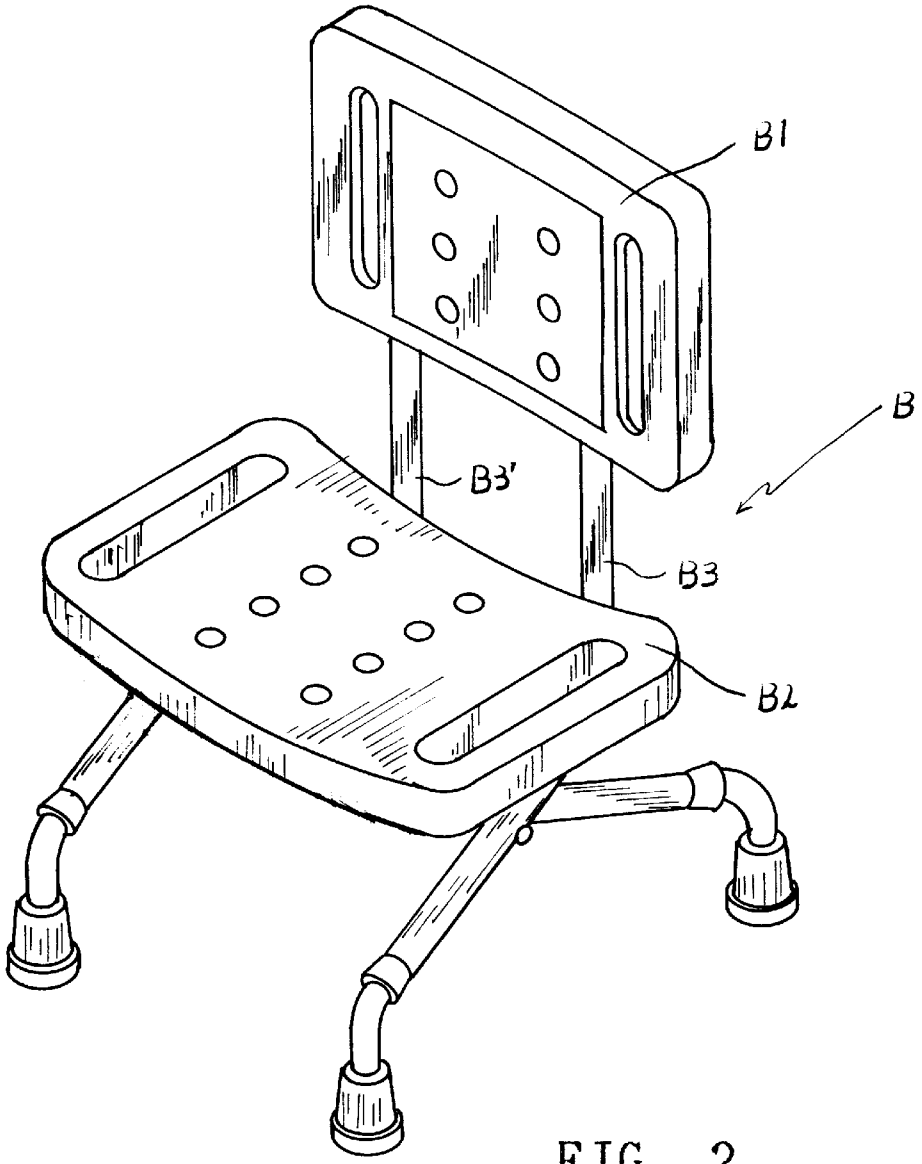
FIG. 2 is an elevational view of another structure of chair according to the prior art.
Figure 3:
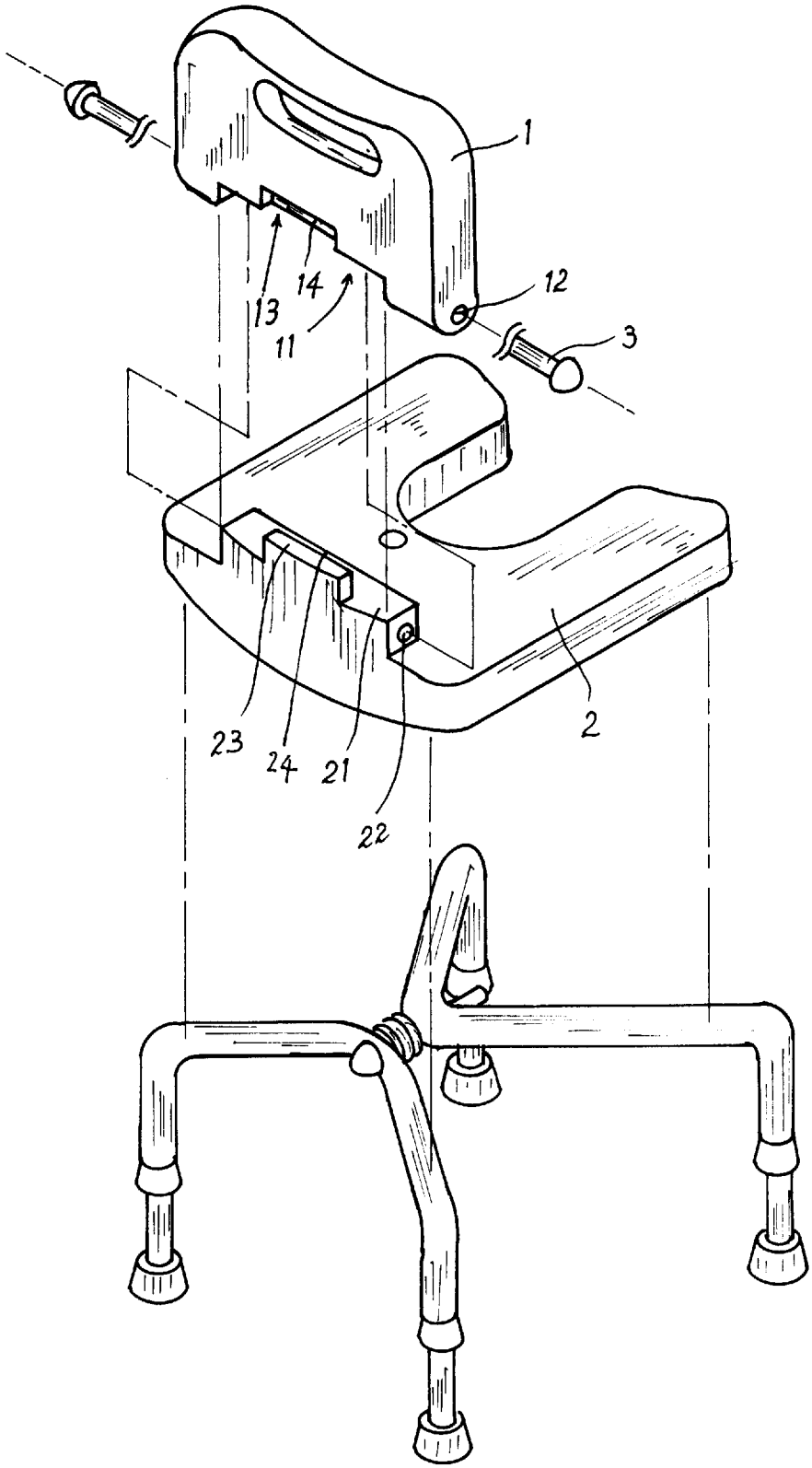
FIG. 3 is an exploded view of a chair according to the present invention.

Referring to FIG. 3 again, the back 1 comprises a transverse bottom chamber 11, two transverse pivot holes 12 aligned at two opposite sides of the transverse bottom chamber 11, and a transverse coupling trough 13 disposed at its back side above the transverse bottom chamber 11, and a rear facing locating surface 14 defining one wall of the transverse coupling trough 13. The seat 2 comprises a transverse block 21 raised from its top side along its rear side and adapted to fit the transverse bottom chamber 11 of the back 1, two pivot holes 22 aligned at two opposite ends of the transverse block 21, an upright stop plate 23 vertically raised from the transverse block 21 in flush with its rear side, and a front facing locating surface 24 forwardly raised from the front side of the upright stop plate 23.

Figure 4:
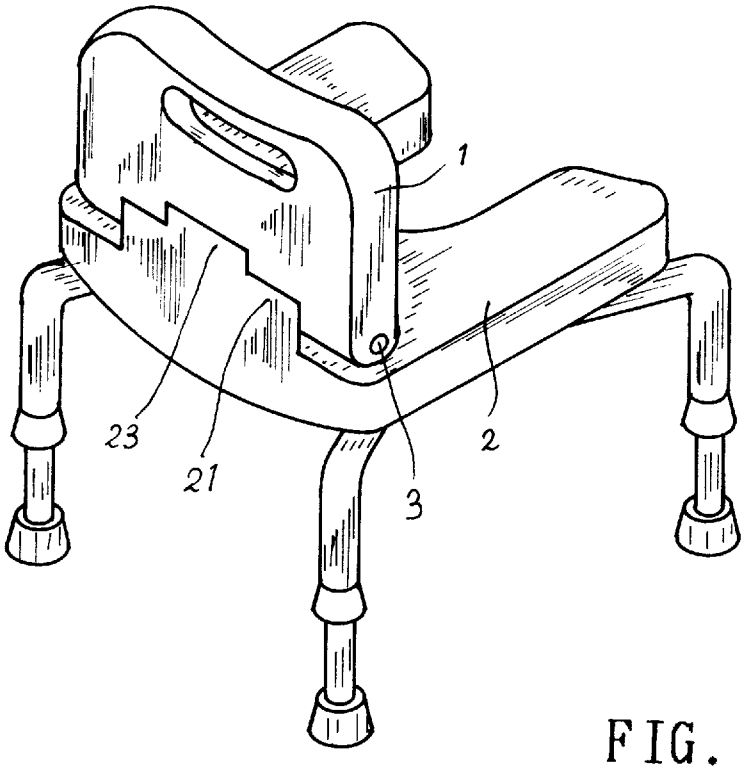
FIG. 4 an elevational view of the present invention, showing the back set in the operative position.
Figure 5:
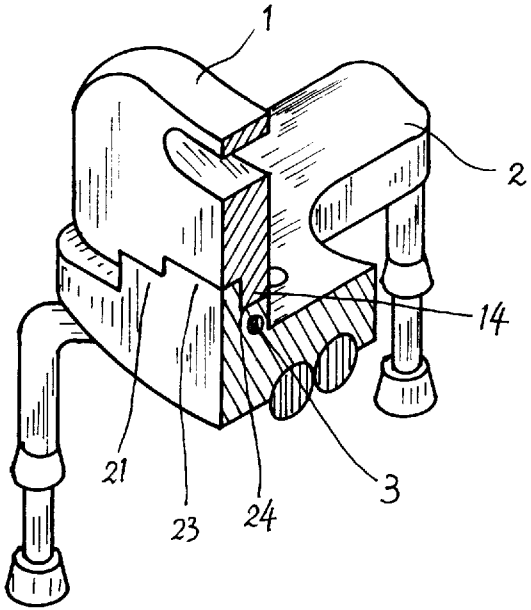
FIG. 5 is a sectional elevation of the present invention, showing the back set in the operative position.

Referring to FIGS. 4 and 5, the back 1 is coupled to the seat 2 by: inserting the transverse block 21 of the seat 2 into the transverse bottom chamber 11 of the back 1 to align the pivot holes 22 of the seat 2 with the pivot holes 12 of the back 1, then connecting the pivot holes 12 of the back 1 to the pivot holes 22 of the seat 1 by pivots 3 for permitting the back 1 to be turned about the pivots 3 between the operative position perpendicular to the seat 2 (see FIG. 4) and the collapsed position closely attached to the top of the seat 2 (see FIG. 6).

Referring to FIGS. 4 and 5 again, when the back 1 is turned to the operative position perpendicular to the seat 2, the upright stop plate 23 of the seat 2 is forced into the transverse coupling trough 13 of the back 1, and the rear facing locating surface 14 of the back 1 is stopped at the front facing locating surface 24 of the seat 2 in front of the upright stop plate 23, and therefore the back 1 is supported on the upright stop plate 23 and the transverse block 21 and retained in the operative position. As one skilled in the art will appreciate, the transverse block 21, the rear facing locating surface 14 and the front facing locating surface 24 together form an overlapping joint.

Referring to FIG. 6 again, when the back 1 is turned forwards, the rear facing locating surface 14 of the back 1 is disengaged from the upright stop plate 23 and the front facing locating surface 24 of the seat 1, and therefore the back 1 can be closely attached to the top side of the seat 2.

While only one embodiment of the present invention has been shown and described, it will be understood that various modifications and changes could be made thereunto without departing from the spirit and scope of the invention disclosed.

What the invention claimed is:

1. A chair with a folding collapsible back comprising:

a chair stand, a seat, a seat back, two seat back pivot assemblies, the pivot assemblies including a pivot pin and a cooperating pivot pin hole, wherein the seat is supported on the chair stand, the seat back being capable of pivoting 90 degrees from a horizontal to a vertical orientation and wherein the seat back is pivotally connected to the seat by said seat back pivot assemblies, wherein said seat comprises:

a transverse block integral to the seat, wherein the transverse block has a transverse block thickness suitable for accommodating one of either of said seat back pivot pins or said pivot pin holes for pivotally cooperating with said seat back, the transverse block having a width sufficient to fit between two opposing said seat back pivot assemblies, and a stop plate integral to the transverse block, the stop plate having a front facing locating surface; wherein said seat back comprises:

a transverse bottom chamber adapted to receive said transverse block, said transverse bottom chamber having a thickness suitable for accommodating one of either of said seat back pivot pins or said pivot pin holes for pivotally cooperating with said transverse block, a transverse coupling trough adapted to receive said stop plate, said transverse coupling trough having a rear facing locating surface, wherein said front facing locating surface cooperatively abuts said rear facing locating surface.

2. The chair of claim 1, wherein the stop plate has a thickness less than the transverse block thickness and the stop plate is alignedly disposed on top of the transverse block so that said transverse block, said rear facing locating surface and said front facing locating surface together form an overlapping joint.

* * * * *